US005326942A

United States Patent [19]

Schmid

[11] Patent Number: 5,326,942

[45] Date of Patent: Jul. 5, 1994

[54] NOISE SUPPRESSION MUFFLER FOR MOISTURE LADEN EXHAUST GASES & METHOD

[76] Inventor: Jerry W. Schmid, 12945 Ixora Rd., North Miami, Fla. 33181

[21] Appl. No.: 15,615

[22] Filed: Feb. 9, 1993

[51] Int. Cl.[5] ..... F01N 7/12

[52] U.S. Cl. ..... 181/235; 181/240; 181/252; 181/258; 181/283

[58] Field of Search ..... 181/231, 232, 235, 240, 181/243, 244, 252, 256, 257, 258, 260, 262, 263, 264, 268, 283; 60/299, 317, 320

[56] References Cited

U.S. PATENT DOCUMENTS

| | | | |
|---|---|---|---|
| 3,163,256 | 12/1964 | Lanning | 181/231 |
| 3,473,323 | 10/1969 | Briggs et al. | 181/240 |
| 4,211,302 | 7/1980 | Matthews et al. | 181/252 X |
| 4,211,305 | 7/1980 | Matthews et al. | 181/252 X |
| 4,440,352 | 8/1983 | Rehnberg et al. | 60/299 |
| 4,843,815 | 7/1989 | Smojver | 60/299 |
| 5,108,716 | 4/1992 | Nishizawa | 60/299 |

*Primary Examiner*—Michael L. Gellner
*Assistant Examiner*—Khanh Dang

[57] ABSTRACT

A muffler is provided for sound dampening of wet exhaust gases. The muffler comprises a canister, or housing, having an inlet and an outlet. The housing is preferably constructed of a plurality of resealable interlocking sections which can be disengaged from one another to allow opening and closing of the housing to permit exposure of the sound dampening element(s) for inspection and replacement thereof or to allow for removal, servicing and replacement of the sound dampening element(s) which are positioned therein. The sound dampening element(s) can be formed from a foamed, heat resistant moldable material, such as a closed-cell concrete.

7 Claims, 2 Drawing Sheets

NOISE SUPPRESSION MUFFLER FOR MOISTURE LADEN EXHAUST GASES & METHOD

BACKGROUND OF THE INVENTION

1. Field of the Invention

This invention is directed to an article of manufacture and to a method. More specifically, this invention is directed to a muffler for effective suppression of environmentally offensive noise and the use thereof in noise reduction, without undue back pressure and impairment in engine performance. By design, this muffler is uniquely equipped for use in conjunction with a pre-cooled exhaust gas stream having a high cooling fluid content, such as typically produced by in-board marine engines. This invention is further directed to a method for noise suppression of moisture laden exhaust gases from in-board marine engines and other internal combustion engines having comparable exhaust streams.

2. Description of the Prior Art

At the outset, it essential to differentiate between the various types of internal combustion engines which, as a natural consequence of their operation, produce both exhaust gases and associated exhaust noise. The internal combustion engine associated with most forms of piston engines used in ground and aircraft conveyance have their respective engines confined and isolated from the passenger in a compartment which is relatively freely cooled and vented by the ambient air which passes over the conveyance during its movement through the (cooling) air. Moreover, ground and aircraft conveyance design generally readily accommodate engine, muffler and exhaust pipe set-ups which further contribute to the isolation and cooling of the exhaust gases without contact or exposure of either heat sensitive components of the conveyance, or the passenger, to either the heat from the exhaust or the exhaust system.

Conversely, in marine, industrial and emergency electrical generator systems, the exhaust system is not generally capable of isolation to the same degree describe above and, accordingly, the amount of heat given off by the exhaust system can create potential hazards to the both surrounding structure and occupants of such structures. Moreover, since the exhaust system is generally isolated from the movement of the circulating air, it requires some pre-cooling before it is exhausted. Thus, it is generally accepted practice to inject a cooling fluid, such as fresh or raw water into the exhaust manifold to lower the temperature of the exhaust gas before it passes through the engine pipe, muffler and exhaust (tail) pipe. The amount of water required to effect such pre-cooling is substantially in excess of that found in the ambient environment, and the muffler and exhaust system associated therewith must be specially designed to accommodate this "wet" exhaust gas stream.

Review of the patent literature has, for the most part, shown little, if any appreciation of the unique requirements of the exhaust systems associated with "wet" exhaust gas streams, notwithstanding differences in kind of the fluid handling problems associated with a dry versus a wet gas and the relative noise production & suppression problems associated with each. The patent literature does in point of fact disclose various muffler and catalytic converter configurations reportedly suitable for use on traditional internal combustion engines found in the automotive and piston powered aircraft. These patents which are described hereinafter, are discussed for the limited purpose of pointing out how dry exhaust gas systems are configured; and, such discussion is neither intended, nor should it be implied, to acknowledge either the equivalency of a wet and dry exhaust gas or that their respective exhaust systems function in the same or in a comparable manner. U.S. Pat. No. 2,946,651 (to Houdry) describes the catalytic treatment of a gas stream containing an oxidizable impurity (e.g. hydrocarbon). In brief, Houdry contacts the gas stream with an oxidation catalyst at high temperature to effect essentially complete combustion thereof. The device used by Houdry in his process consists of a thermally insulated housing containing a gas permeable bed which functions both as heat exchanger and as a heat generator. The oxidation catalyst in Houdry is maintained on a bed of dense refractory material and the gas is pre-heated to a temperature of about 1000 degrees Fahrenheit by the oxidation (combustion) of fuel contained (injected) in the waste stream. As such fuel is oxidized, the bed temperature is increased within the combustion chamber of the converter and the heat generated therein is transferred, (by a heat exchanger within the converter), to a second or gas processing area within the bed so as to maintain the temperature in this processing area at sufficient levels to effect essentially complete catalytic oxidation of the lower temperature gases. In summary, the Houdry treatment, and the associated equipment necessary for the implementation thereof, are typical of the configuration used in the processing of essentially "dry" gas streams containing unburned hydrocarbons.

U.S. Pat. No. 3,159,237 (to Thomas) described a muffler of relatively unique design and construction at the time his device was conceived. In one of the embodiments of his invention, the Thomas muffler uses a vesicular metal element contained within a housing as a replacement for the more traditional acoustical packs of copper, steel or glass wool. The vesicular sound deadening media described by Thomas for his acoustical pack can be either of "open" or "closed" cellular mass having an essentially solid, non-cellular skin or casing. The various configuration of the Thomas muffler utilizing such vesicular materials are illustrated in FIGS. 1-9 of his patent. In each such embodiment of his device a channel a gas inlet pipe introduces exhaust gas into the muffler where it contacts and passes through the vesicular mass and thereafter exists the muffler through an outlet pipe, which is either a continuation of the inlet or offset relative to the inlet. The muffler described by Thomas is typical of the design which can be utilized to deaden the sound produced by internal combustion engines and, accordingly, is competent to muffle the sound of "dry" exhaust gases.

U.S. Pat.No. 3,163,256 (to Lanning) describes the use of a ceramic honeycomb baffle in a muffler to deaden the sound produced by an internal combustion engine. The selection of a ceramic as the material of choice by Lanning is based upon the inventor's desire to produce a "resistive" type of muffler that was both strong and capable of withstanding high temperatures under chemically corrosive conditions. The materials of choice identified by Lanning appear at Column 3,lines 3-30, and include various refractory components that are compatible with ceramic fabrication methods and materials. The muffler described by Lanning is typical of the design which can be utilized to deaden the sound produced by internal combustion engines and, accordingly, is competent to muffle the sound of "dry" exhaust gases.

U.S. Pat. No. 3,495,950 (Barber et al ) describes a catalytic muffler for exhaust emission control. The disclosure of Barber which is of particular interest in the context of evaluation of Applicant's invention relates to the use of an air injection system to supplement the oxygen (unburned air) in the exhaust gases to effect more complete oxidation of the hydrocarbon residues thereof. More specifically, the Barber patent describes the custom and practice in design of catalytic conversion systems to inject pre-heated air into the exhaust stream to supply a supplemental quantity of oxygen to improve the efficiency of the catalytic conversion process. It is important to note the requirement of the designer of such system to pre-heat the injected air (so as not appreciably lower the temperature of the exhaust gases) is simply his acknowledgement of the criticality of temperature to the oxidation process and, thus, his desire to maintain catalytic converter temperatures as high as possible for effective oxidation of the hydrocarbon residues in the exhaust. The catalytic converter described by Barber is typical of the design which can be utilized to both chemically process such exhaust gases and deaden the sound produced by internal combustion engines. Accordingly, Barber's device is competent to muffle the sound of "dry" exhaust gases.

, U.S. Pat. No. 3,692,497 (to Keith et al) describes a catalytic converter for treatment of exhaust gases which incorporates unique internal modification to the converter housing to maintain the catalyst supporting element securely in place during use (treatment of exhaust gas). Apparently Keith and others had observed that the catalyst support can be physically displaced within the converter housing during the rigors encountered in service; and that such displacement can result in incomplete oxidation of exhaust gases which may bypass the catalyst supporting element. This problem is resolved in the structure described by Keith in providing an inward extension of the converter housing which physically engages the catalyst supporting element and thereby maintains such element in place in the housing. The catalytic converter described by Keith is otherwise typical of the design which can be utilized to process exhaust gases produced by internal combustion engines and, accordingly, is competent to oxidize "dry" exhaust gases. U.S. Pat. No. 3,852,042 (to Wagner) describes describes a unique catalytic converter design wherein a pair of spaced, dome-shaped, perforated screens (positioned between the converter inlet and the catalyst bed) serve to dampen and modulate exhaust gas pollution which causes vibrational movement of the catalyst bed within the converter housing and, thus, minimize physical damage to such a relatively fragile bed. Wagner's converter design eliminates the above vibration by diffusing the incoming gases within the converter chamber. The catalytic converter described by Wagner is otherwise typical of the design which can be utilized to process exhaust gases produced by internal combustion engines and, accordingly, is competent to oxidize "dry" exhaust gases.

The foregoing patents have been described in chronological order based upon their date of issue. Accordingly, the reader should not attribute any relative weight, as to their pertinence on the patentability of the Applicant's invention, on such order of discussion. All of the foregoing simply describe what has come to be recognized as generally accepted alternative designs for the processing and muffling of "dry" exhaust gases. It is further particularly apparent that catalyst bed temperature is critical to effective oxidation of exhaust gases; and, that converter efficiency cannot tolerate the introduction of ambient temperature air without suffering a demonstrative reduction in converter performance. Accordingly, where supplemental air is introduced into the exhaust stream to supply supplemental oxygen, it must be pre-heated. Thus, the designs described for catalytic converters all contemplate the maintenance of extremely high bed temperatures.

By way of contrast, the use and operation of in-board engines (and internal combustion engines which are similarly confined) requires and contemplates the precooling of the exhaust by liquid injection to protect both the immediate environment of the engine and persons in proximity to its operation. The traditional designs for both catalytic converters and mufflers are manifestly inadequate for sound dampening of "wet" exhaust gas streams due to their mandated low temperature of operation and the high fluid content of the "wet" exhaust which passes through the internal sound deadening elements that must be contained therein. Where an effort has been made to substitute the more traditional muffler (designed for automotive use) in the marine environment, its performance has been inadequate because of the unique and strenuous demands of a "wet" exhaust. Accordingly there is a continuing need to provide a muffler that can accommodate a "wet" exhaust, (such as present in cooling of in-board marine engines) without fouling from debris contained in the injected cooling water and yet provide the requisite sound deadening qualities.

OBJECTS OF THE INVENTION

It is the object of this invention to remedy the above as well as related deficiencies in the prior art.

More specifically, it is the principal object of this invention to provide a muffler of unique construction and design suitable for use in the sound dampening of an internal combustion engine that produces a wet exhaust gas.

It is another object of this invention to provide a muffler having a replaceable sound dampening element of cellular construction.

It is yet another object of this invention to provide a muffler in which the housing thereof consists of a canister having multiple sound dampening elements.

It is still yet another object of this invention to provide a muffler having a plurality of sound dampening elements in which each of the separate sound dampening elements differ in terms of its relative physical arrangement to one another thereby resulting in misalignment of their respective sound dampening channels within the cannister; or, alternatively, have elements wherein the sound dampening channels of each such element differ from one another in physical design or resistance to exhaust gas flow.

Additional objects of this invention include providing a method for effective sound dampening of a wet exhaust from a marine engine without the attendant reduction in power output thereof.

SUMMARY OF THE INVENTION

The above and related objects are achieved by providing an improved muffler of unique construction and design for sound dampening of a wet exhaust. The muffler in its most general and broadest terms consists of a canister, or housing, having an inlet and an outlet. The housing is preferably constructed of a plurality of resealable interlocking sections which can be disengaged from one another to allow opening and closing of the housing to permit exposure of the sound dampening element for inspection and replacement thereof to allow for removal, servicing and replacement of the sound dampening elements which are positioned therein. The sound dampening pathway is thereby maintained to allow for relatively unrestricted (low back-pressure) passage of the wet exhaust gases through the muffler. The sound dampening elements can be formed from a foamed, heat resistant moldable material, such as concrete. In the preferred embodiments of this invention, the foam is formulated and processed to provide a low density mass of predominantly closed-cell construction. The density and physical shape of the sound dampening mass can vary depending upon the size of the muffler and the geometry of the canister. Alternatively, the sound dampening mass can take the form of wafers or other pre-cast or machined shapes which can be simply loaded into the canister in much the same way as in servicing a disposable oil or air filter (or other equivalent device) requiring replacement or regeneration of the active or functional medium.

DETAILED DESCRIPTION OF THE INVENTION, INCLUDING PREFERRED EMBODIMENTS

Figure 1:
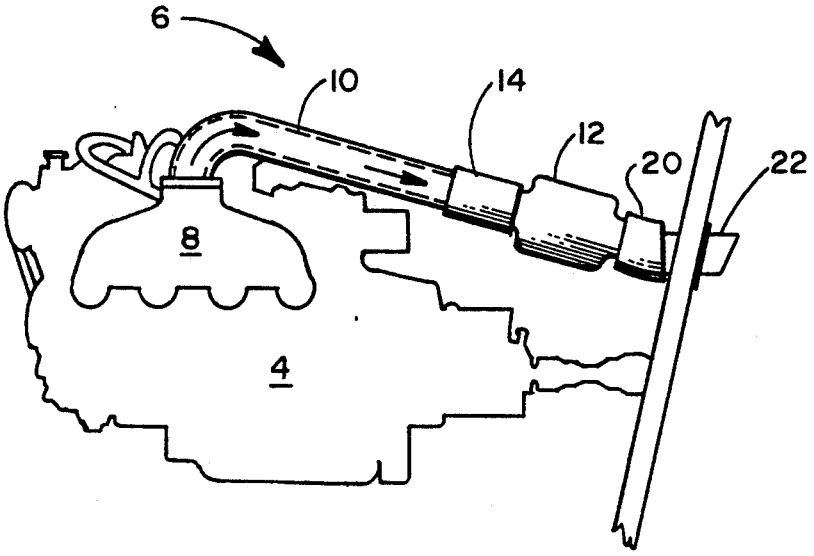
FIG. 1 is a diagrammatic view of an in-board marine engine illustrating the relative placement of the various components of the exhaust system thereof.

The description of the invention which follows makes reference to one or more of the above Figures in order to aid in the understanding thereof. Wherever an element or component of a drawing appearing in more than one Figure is the same, it is assigned a common reference numeral.

The in-board engine compartment of a recreational power boat is isolated from both the boat passengers as well as the water through which the craft is propelled. Thus, unlike the internal combustion engines which power both vehicular conveyance and aircraft, neither the engine nor the exhaust system of the water craft benefit from the cooling effects of ambient air which circulates around both the engine and the exhaust system. Moreover, as noted above (and once again emphasized), because of the necessary isolation of the engine and the engine compartment from the water surrounding the water craft, the temperature within the water craft engine compartment can approximate the temperature of the exhaust gas unless special steps are implemented to effect the cooling thereof.

As illustrated in FIG. 1, the engine (4) of a water craft is housed below deck in an essentially water tight compartment. In the illustration provided in FIG. 1, the engine is provided with a dual exhaust system; and each cylinder bank thereof has a separate and independent exhaust system (6). The exhaust system shown in FIG. 1 consists of an exhaust manifold (8), which collects exhaust gases from each of the cylinders from a compression head of the engine, and channels such gases into a common conduit or pipe where they are expelled into the environment. This common conduit generally consists of a riser or engine pipe (10) which conducts the exhaust gases from the exhaust manifold to a muffler (12). The muffler is connected to the riser or engine pipe at an inlet tube (14) on the muffler housing (16). Upon entering the muffler through the inlet pipe, the hot exhaust gases contact the sound dampening element (18) within the cannister and are circulated therein until they are expelled through the outlet pipe (20) and ultimately discharged into the ambient environment through exhaust (tail) pipe (22). Because of the confined nature of the water craft's engine compartment, the exhaust gases are cooled, upon entering the exhaust system riser, by injection of fresh or raw (untreated) fluid, generally water, into the riser. As is readily appreciated, the cooling water can be first circulated through the cooling system of the engine prior to introduction into the riser. The volume of cooling fluid and the location and the manner of injection thereof into the exhaust gas stream, are engineered to effectively reduce the exhaust gas temperature to about 150° to about 190° F and thereby the temperature within the engine compartment, accordingly.

The cooling fluid is typically supplied by the body of water which surrounds the water craft. The "cooled" exhaust gas can, thus, contain microorganisms native to the injected water, as well as dissolved minerals, particulate matter and other contaminants. The construction and design of the muffler of the subject invention can readily accommodate this heterogeneous gas stream by virtue of the non-absorbing (fluid impervious) characteristics of the sound dampening medium and the relatively low restriction muffler design. Moreover, servicing capability for the muffler can be provided by fabrication of the muffler body (cannister) in two or more resealable, interlocking sections (not shown) which permit its disassembly and thereby the periodic inspection and replacement (where appropriate) of the sound dampening medium to insure both maintenance of low resistance performance and adequate sound dampening characteristics.

The sound dampening medium of the preferred muffler embodiments of this invention is fabricated from a foamed composition having sufficient mechanical strength, thermal resistance and chemical stability to withstand the pulsating exhaust gases as well as the heat and corrosive environment encountered by a marine engine; which typically involves operation in extremes of temperature and the corrosive action of sea water. In the preferred embodiments of this invention, the sound dampening element is prepared by well-know fabricating techniques; utilizing existing equipment and readily available materials. Alternatively, this element can be formed from naturally occurring porous substances, such as pumice, by simply machining the pumice to the desired dimensions.

In order to insure uniform quality, and reproducible performance, it is preferred that this element comprises a synthetic material, such as a foamed concrete or glass, having an essentially closed cellular structure. Depending upon the physical size and geometry of the element fabricated from the foregoing material, it may be desirable to incorporate internal reinforcement therein. The composition of the foam can also include the usual processing aids, which may be fugitive or non-fugitive, such as air entraining agents, binders, plasticizers and the like.

The following Example describes the manner and equipment used in the fabrication of the sound dampening element of the muffler of the invention. Parts and percentages appearing in such Example are by weight unless otherwise stipulated. In addition, the equipment used in the fabrication and testing of the resultant foamed product is also conventional, as are the test protocols, unless indicated to the contrary.

EXAMPLE I

A concrete foam was prepared by mixing portland cement and water in the appropriate proportions, along with an air entraining agent in the amount recommended by the manufacturer. The air entraining agent of choice is marketed under the ELASTIZELL trademark by the Elastizell Corporation of America (Ann Arbor, Mich.). The relative proportion of ingredients is adjusted to provided a composition having a cast density of at least 35 lbs/ft$^3$. The foregoing mix was cast by pouring into a cylindrical mold approximately 7" in diameter to a height of 10 to 12". Upon adequate curing, the resulting billet was removed from the mold and allowed to cure for a total of 7 days. The billet was, thereafter, cut into wafers ranging in thickness from 3" to 5" and a series of regularly spaced holes (sound dampening channels) was drilled through each of the wafers. The size, arrangement and number of holes drilled through each wafer is in proportion to the diameter of the inlet pipe through which the exhaust gases pass before entering the muffler. The total cross-sectional area of the holes in the wafer, in relation to the diameter of the inlet tube, must permit the exhaust gases to enter and pass through the muffler without any appreciable increase in back pressure; and, preferably result in a pressure drop from the inlet to the outlet pipe of the muffler.

Figure 2:
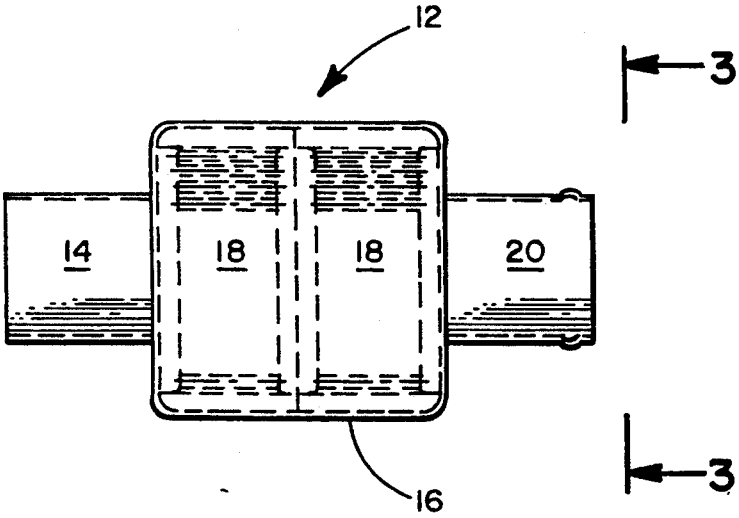
FIG. 2 is an enlarged and exploded view of the muffler of the exhaust system illustrated in FIG. 1 wherein the muffler body (canister) is shown to contain two separate sound dampening elements or wafers arranged in series relative to one another.
Figure 3:
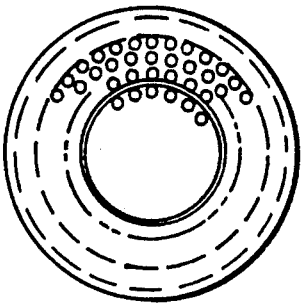
FIG. 3 is a cross-sectional view of a wafer of muffler of FIG. 2 illustrating the arrangement of the sound dampening channels which have been drilled through such wafer.
Figure 4:
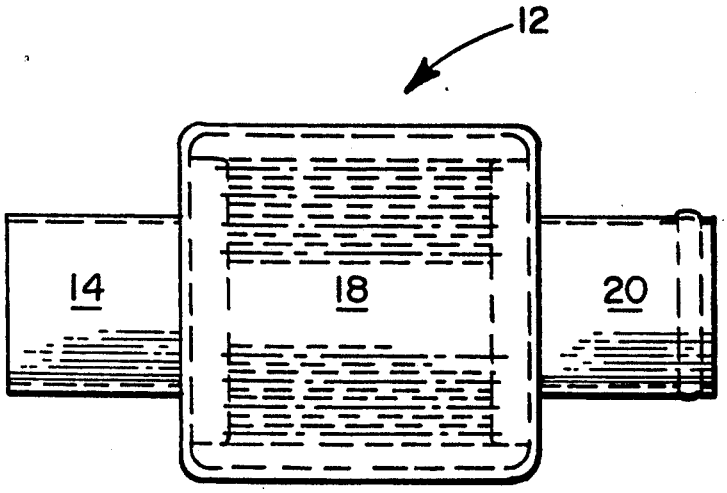
FIG. 4 is an enlarged and exploded view of the muffler of the exhaust system illustrated in FIG. 1 wherein the canister is shown to contain a single sound dampening wafer.

In one of the preferred embodiments of this invention (illustrated in FIG. 2) the muffler contains two wafers arranged in series within the muffler housing. Each of the wafers is of a similar thickness (3.5" to 4.0"), however, the holes of each are deliberately misaligned relative to one another to provide a tortuous path for the exhaust gas as it passes through the muffler from one wafer to the other and, thereby, enhances the sound dampening effect (much in the same way as baffling is used in conventional muffler design).

The shape or contour of the muffler body (cannister) illustrated in the drawings which accompany the description of the invention has been represented as a simple cylinder. Because of the simplicity in the fabrication of the sound dampening element, and the ability to create baffle-like channels by manual misalignment of contiguous wafers, it is now possible to custom fabricate mufflers to accommodate virtually any engine compartment configuration utilizing the concept of this invention. The only engineering criteria that need be followed is that the muffler configuration be of a design that can accommodate the sound dampening elements, which can be arranged, (relative one another and to the inlet tube and the outlet tube) so as to provide a sound dampening channel through the muffler, without any appreciable increase (and preferably a decrease) in back pressure.

In another embodiment of this invention, each of the wafers is modified to provide for more controlled distribution of the exhaust gas, among the sound dampening channels, as it enters the muffler and impinges upon the sound dampening element. This is accomplished either by providing (i) a gap between the inlet of the cannister and the foamed element (wafer) contained therein or, (ii) alternatively, by modifying the shape of the wafer surface upon which the gases impinge, to create a cavity to allow for the diffusion of the exhaust gases along the surface of the wafer upon the entry thereof into the cannister. Similar modification is preferably made to the surface of the wafer proximate to the outlet pipe so as to allow for exhaust gas to collect (from the sound dampening channels) between the wafer and the outlet port in the cannister and thereby minimize back-pressure through the muffler.

The foregoing description and Example has been provided as illustrative of a limited number of preferred embodiments of this invention and are neither intended nor should such be construed as delimiting the scope the novel concept which is set forth in the following claims.

What is claimed is:

1. An exhaust system for an internal combustion engine having an exhaust manifold for collection of exhaust gases from a plurality of individual combustion chambers of an internal combustion engine, a riser having an inlet and an outlet, the inlet thereof being operatively connected to the exhaust manifold and the outlet thereof being connected to a muffler, and an injection system for introduction of a cooling fluid into the exhaust system to lower the temperature of the exhaust gases before such gases enter the muffler, wherein the muffler comprises:

(i) a housing which defines an internal chamber;

(ii) an inlet pipe for conducting a fluid laden exhaust gas from an exhaust system riser into the internal chamber; and, (iii) a sound dampening element within said internal chamber, said element comprising a low density, foam composition of closed-celled construction and defining sound dampening channels surrounded by closed-cell, porous mass through said internal chamber.

2. The improved system of claim 1, wherein the muffler housing comprises a plurality of resealable interlocking sections which can be disengaged from one another to allow opening and closing of the housing to permit exposure of the sound dampening element for inspection and replacement thereof.

3. The improved system of claim 1, wherein the muffler is provided with multiple sound dampening elements arranged in series relative to one another within the internal chamber.

4. The improved system of claim 3, wherein each of the sound dampening elements is provided with a plurality of sound dampening channels.

5. The improved system of claim 4, wherein the sound dampening channels of each of two contiguous elements are dissimilar as to a number, arrangement, size or placement relative to one another.

6. The improved system of claim 1, wherein the muffler is provided with a sound dampening element comprising a naturally occurring or synthetic foam.

7. A method for suppression of exhaust noise of an internal combustion engine having an exhaust manifold for collection of exhaust gases from a plurality of individual combustion chambers of an internal combustion engine, a riser having an inlet and an outlet, the inlet thereof being operatively connected to the exhaust manifold and the outlet thereof being connected to a muffler, and an injection system for introduction of a cooling fluid into the exhaust system to lower the temperature of the exhaust gases before such gases enter the muffler, wherein the method comprises:

passing said wet exhaust gases through a muffler comprising (i) a housing which defines an internal chamber;

(ii) an inlet pipe for conducting a fluid laden exhaust gas from an exhaust system riser into the internal chamber; and, (iii) a sound dampening element within said internal chamber, said element comprising a low density, foam composition of closed-celled construction and defining sound dampening channels surrounded by closed-cell, porous mass through said internal chamber.

* * * * *